US005299792A

United States Patent [19]

Kollann et al.

[11] Patent Number: 5,299,792

[45] Date of Patent: Apr. 5, 1994

[54] APPARATUS FOR INSERTING A MARKER STRIP IN A STACK OF SHEETS DURING THE STACKING THEREOF

[75] Inventors: Rolf Kollann, Herten; Hans-Georg Sippel, Düsseldorf; Peter Voss, Jüchen; Ralf Zehl, Erkrath, all of Fed. Rep. of Germany

[73] Assignee: Jagenberg Aktiengesellschaft, Dusseldorf, Fed. Rep. of Germany

[21] Appl. No.: 908,710

[22] Filed: Jul. 2, 1992

[30] Foreign Application Priority Data

Jul. 4, 1991 [DE] Fed. Rep. of Germany ..... 4122111

[51] Int. Cl.[5] ..... B65H 33/04; B65G 57/00

[52] U.S. Cl. ..... 270/95; 414/789.5; 414/793.4

[58] Field of Search ..... 270/95; 414/789.5, 794.3, 414/793.4

[56] References Cited

U.S. PATENT DOCUMENTS

| | | | |
|---|---|---|---|
| 2,619,883 | 12/1952 | Andren | 270/95 |
| 2,629,300 | 2/1953 | Smith | 270/95 X |
| 3,205,739 | 9/1965 | Meyer-Jogenberg | 270/95 X |
| 3,458,186 | 7/1969 | Schmidt | 270/95 X |
| 4,749,179 | 6/1988 | Hornung | 414/789.5 X |
| 5,020,786 | 6/1991 | Kimura et al. | 270/95 |

FOREIGN PATENT DOCUMENTS

| | | | |
|---|---|---|---|
| 296346 | 12/1988 | European Pat. Off. | 414/789.5 |
| 1252708 | 10/1967 | Fed. Rep. of Germany . | |
| 1261388 | 2/1968 | Fed. Rep. of Germany . | |
| 2711824 | 9/1978 | Fed. Rep. of Germany | 414/789.5 |
| 3539099C2 | 9/1989 | Fed. Rep. of Germany . | |
| 3823806C2 | 8/1990 | Fed. Rep. of Germany . | |
| 21368 | 2/1980 | Japan | 414/789.5 |
| 214448 | 9/1988 | Japan | 270/95 |
| 697537 | 9/1953 | United Kingdom | 414/789.5 |
| 2109775 | 6/1983 | United Kingdom . | |

*Primary Examiner*—Edward K. Look
*Assistant Examiner*—John Ryznic
*Attorney, Agent, or Firm*—Herbert Dubno

[57] ABSTRACT

A stacker for sheets, e.g. of cardboard or paper, is equipped with a device for inserting Marker strips or tabs within the stack to indicate predetermined numbers of sheets therein, e.g. for identification of reams. The inserter has a rigid channel Mounted on a frame moveable on a traverse transverse to the direction of sheet feed and the channel at its outlet is rigidly connected to a tongue having a substantially horizontal underside and moved with the outlet of the channel in a rectangular pattern with only vertical and horizontal path segments so that the tongue can be withdrawn from the stack without changing its orientation horizontally after a strip has been inserted into the gap formed by the tongue in the stack and alongside the tongue.

7 Claims, 2 Drawing Sheets

APPARATUS FOR INSERTING A MARKER STRIP IN A STACK OF SHEETS DURING THE STACKING THEREOF

FIELD OF THE INVENTION

Our present invention relates to an apparatus for inserting a marker strip in a stack of sheets during the stacking thereof, especially for stacks of paper or cardboard sheets in which a wedge-shaped tongue is lowered onto the stack and the marker strip or tab is fed to latter the from a roll or supply of the strip and from which the marker strip is severed.

BACKGROUND OF THE INVENTION

In the stacking of sheets, generally in conjunction with a transverse cutting of the sheets from a continuous web of the paper or cardboard as the sheets are advanced to a stacking location, it is known to provide indicia between reams or collections of predetermined numbers of sheets in the stack, in the form of tabs or marking strips which are laid into the stack as the stack is formed.

Since the insertion of a marking strip can leave a gap in the region of the edges of the sheets, it is preferred in prior art systems to provide the marker insertion device at the sheet-supply side of the stack, corresponding to the rear of the stack.

In this case, the gap formed as the sheets fall on the stack is used to provide the space into which the marker tab or strip is inserted. An apparatus of this type is described in German Patent 38 23 806.

In stacking devices in which a continuous deposition of sheets if provided even during a stack replacement, i.e. removal of a completed stack, the feed side is generally occupied by stack forming and stack replacement elements to the extent that the arrangement of one or more marker inserters at this side is not possible. This is especially the case when the marker insertion device must be adjusted transverse to the feed direction to accommodate different sizes of the sheets.

German Patent 35 39 099 describes an apparatus in which the marker strips are inserted in a direction opposite to the sheet transport direction for stacking on the freely accessible front side of the stack. A tongue in the form of flat wedge with downwardly inclined flanks can be introduced into the outline of the stack, lowered onto the stack and retracted with only slight lifting out of the outline of the stack before a new introduction of the tongue into position to be lowered onto the stack.

The marker strip is fed from a supply roll through a passage within the tongue opening onto the stack and is cut from the continuous web. The marker strip is thus introduced into a gap in the stack maintained by a downwardly inclined flank of the tongue. As a consequence, as the tongue is retracted below the sheets piled on top of it, it will not pull out the marker strip of paper which has been introduced, especially since the tongue is slightly lifted during the retraction.

Since only the tongue is moved while the guide passage for the marker strip is of fixed height, the strips can only be inserted at a single level of the apparatus. The apparatus cannot accommodate significant changes in height of the stack surface at which the marker strip is to be inserted, for example resulting from bulging at the edges of the sheets because of the trapping of air in the stack or profile fluctuation of the stack or upon stacking on auxiliary stacking platforms during a stack change.

As a result, the marker strip insertion can interfere with stacking, the insertion tongue can damage the stack or the stack can cause the tongue to tilt.

In short, while the aforedescribed apparatus can operate relatively efficiently if the marker strip insertion is always to be effected at a single level and the disturbances described do not occur, in the presence of such disturbance factors, it may become unreliable and a detriment to the stacking operation.

OBJECTS OF THE INVENTION

It is, therefore, an object of the invention to provide an apparatus for the purposes described, namely, the insertion of marker strips into a stack of sheets during the formation of the stack, which can accommodate various heights of the stack surface and is significantly more reliable than the earlier apparatus and can operate without damage to the stack.

Another object of this invention is to provide an improved marker strip inserter in a stacking apparatus which is free from the drawbacks of earlier systems.

SUMMARY OF THE INVENTION

These objects are attained, in accordance with the invention, by mounting the wedge-shaped tongue at the end of a feed channel rigidly adjacent the outlet opening for the strips and providing the tongue SO that its underside is substantially horizontal and that without changing the inclination of its underside to the horizontal, can be retracted horizontally from the stack. The tongue, therefore, is fixedly connected to the guide channel at the end of the latter and the guide channel feeding the strip from which the marker tab is to be severed to the tongue and opening adjacent the tongue which is wedge-shaped, although its underside is horizontal.

After the tongue has been placed on the uppermost sheet of the stack, subsequent sheets piling on the tongue, the tongue can be retracted horizontally from the stack without changing the angle of the underside of the horizontal which may be zero or at most is only at a very slight angle of inclination to the horizontal.

The pressure of the sheets above the tongue hold the marker strip in the stack and there is, therefore, no additional pressure of the tongue on the edge of the stack during retraction of the tongue which can mark the stack.

As a consequence of the fixed connection between the guide channel and the tongue, both can be positioned independently of the instantaneous height of the stack on the upper surface with great precision, thereby improving the reliability of the device even in the case of varying heights of the stack surface.

According to a feature of the invention, at the end of the guide or feed channels, below the tongue, a proximity sensor is provided which registers proximity of the tongue and the end of the guide channel to the upper surface of the stack.

This proximity sensor may be a light sensor transmitting a horizontal light beam and an optical receiver for registering reflection from the light transmitter.

According to another feature of the invention, the tongue is movable along a closed rectangular path with horizontal and vertical path segments.

The guide passage can be mounted so as to be tiltable on a frame and can be pressed by a spring into a position in which the underside of the tongue is horizontal or has only a slight angle of inclination to the horizontal as previously described. The frame can be transversely displaceable on a traverse of the machine structure extending transversely to the feed direction of the sheets. This frame on its traverse can be coupled to the stack-forming unit or platform system which is transversely shiftable for format or size adjustment.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
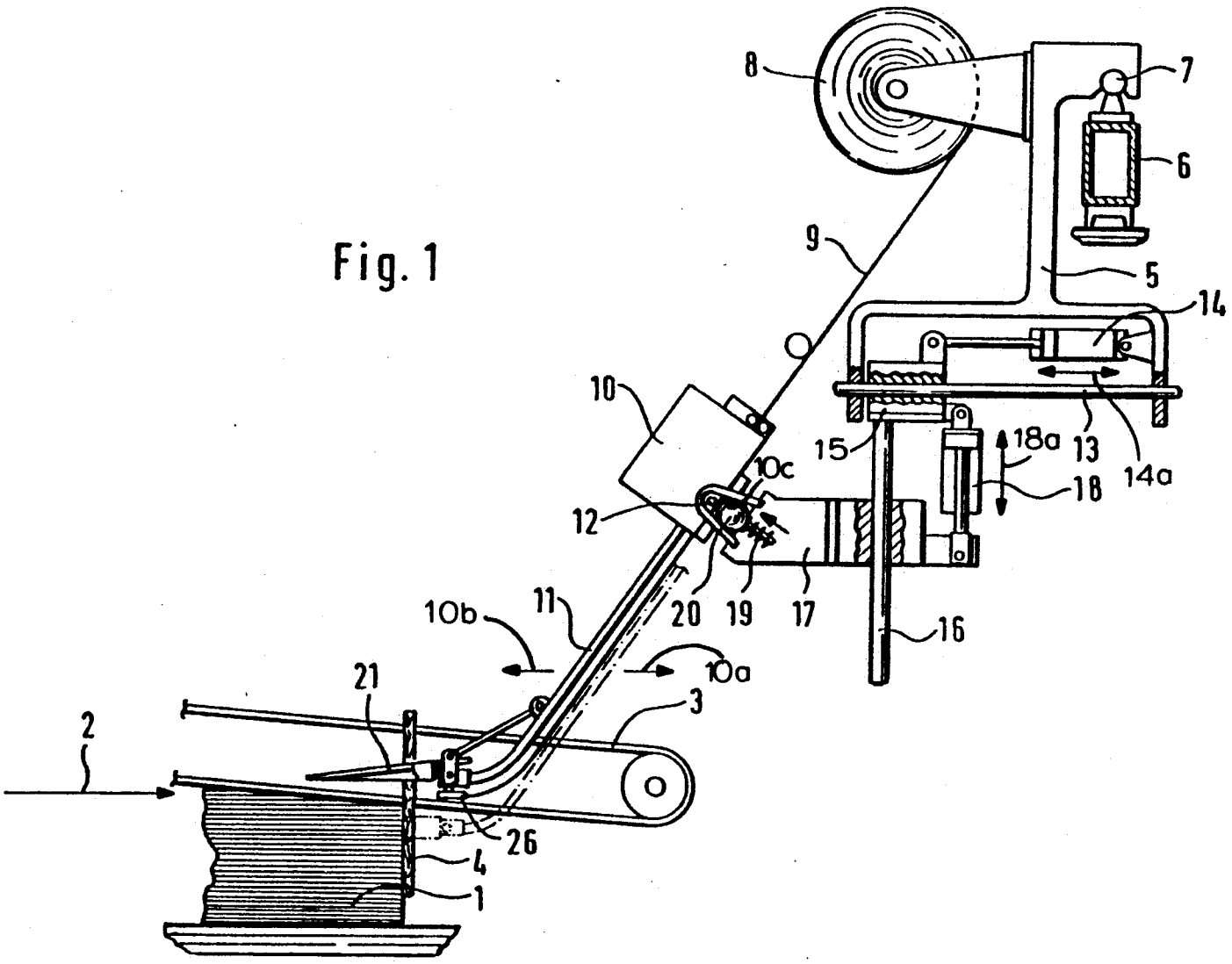
FIG. 1 is a schematic side view of a marking strip inserter according to the invention, partly broken away and partly in diagrammatic form.

FIG. 1 shows highly diagrammatically the deposition platform carrying stack 1 of sheets arriving in the direction of arrow 2 in a shingle pattern, so that the sheets can be continuously deposited upon the stack 1. The deposition platform of the stacker can be continuously lowered by means not shown to maintain the height of the drop of the sheets onto the stack substantially constant. To guide the sheets onto the stack, a plurality of spaced-apart upper belts 3 can be provided. The leading edges of the sheets come to abut against an abutment board 4 defining the front side of the stack, the abutment board 4 being located between the upper belts 3 and the platform.

The belts 3 and the board 2 may be transversely adjustable to suit sheets of different size as is conventional in stacking machines.

At the front side of the stack 1 which is opposite from the side at which the sheets are fed to the stack, a marking tab inserter is provided and comprises a frame 5 which rides on a traverse 6 which can extend the full width of the machine transversely to the feed direction represented by arrow 2 and is shown to be disposed well above the sheet travel path.

A wheel, roller or like antifriction system can be provided at 7 to form a round guide for the frame 5 on the traverse 6.

The marking tab inserter can further comprise a supply roll 8 journaled on the frame 5 and feeding a web or strip 9 of the marker material along an inclined path from above toward the stack the strip 9 passing in a direction opposite to the direction of feed 2 of the sheets.

A device 10 also mounted on the frame 6 serves to linearly advance the strip 9 in increments equal to the length of the tab to be inserted into the stack. The feeder 10 has a guide channel 11 mounted thereon, the guide channel receiving the strip which is shifted through this channel.

The housing of the feeder 10 can be horizontally shifted in the direction of feed of the sheets and opposite to the direction of feed of the sheets as represented by the arrows 10*a* and 10*b*. It can also be tilted about an axis 12 to a limited extent. For this purpose on the fork-shaped underside of the frame 5, a horizontally extending guide bar 13 is mounted and carries a slide 15 which is horizontally shiftable as represented by the double-headed arrow 14*a* by a piston-cylinder unit 14 braced between the slide 15 and the frame 5.

The slider 15 carries a guide bar 16 which is vertical and extends downwardly. On this bar 16 a further slider or holder 17 is vertically shiftable (double-headed arrow 18*a*) by a further piston-cylinder unit 18 braced between the slider 15 and the holder 17.

The housing of the feed unit 10 is mounted on the holder 17 so as to be pivotable about the horizontal axis 12 which is perpendicular to the bar 16 and to the bar 15 and transverse to the direction of feed 2 of the sheets. The device 10 is biased by a compression spring at a preset angle from which it may be deflected about the axis 12, against the spring force.

More particularly, the compression spring 19 is fastened on the holder 17 and urges a ball 20 into a wedge-shaped transverse groove 10*c* formed on the unit 10 so that the limited tilting thereof against the spring force is possible. This tiltable mounting of the housing of the feed unit 10 prevents damage to the unit in the event the stack 1 is accidentally moved upwardly or downwardly while the tongue 21, to be described in greater detail, at the end of the channel 11, is engaged in the stack 1.

Figure 2:
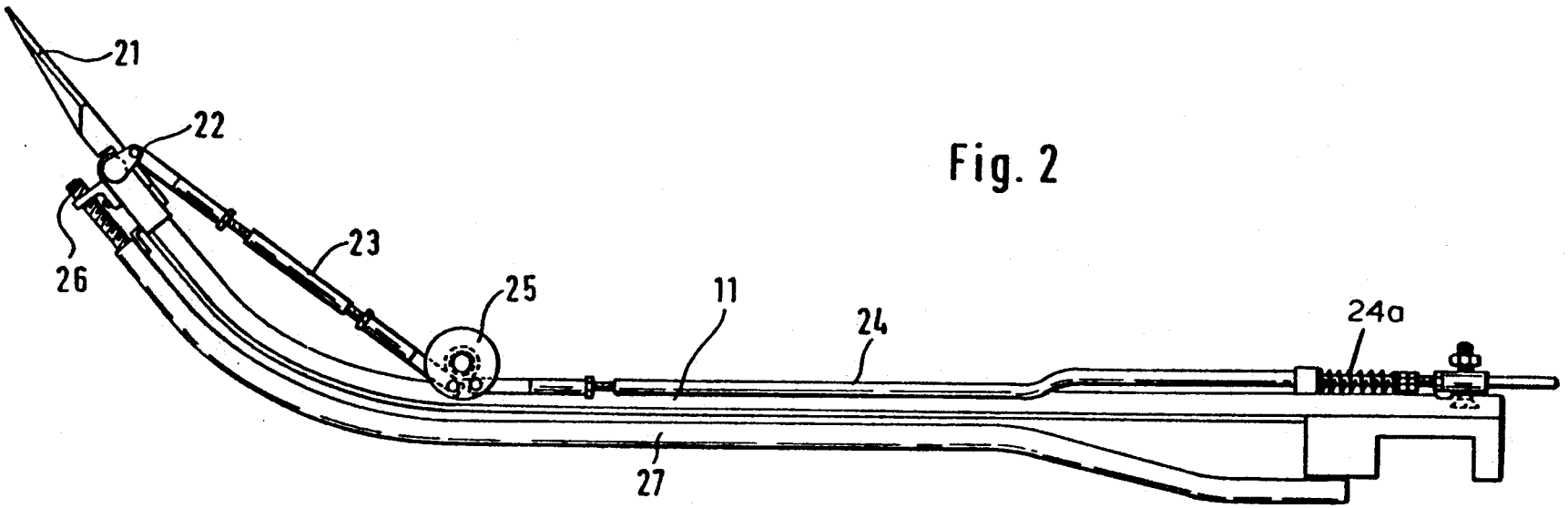
FIG. 2 is a detail view, although seen from the side of the guide channel with the tongue for inserting the marker strip.
Figure 3:
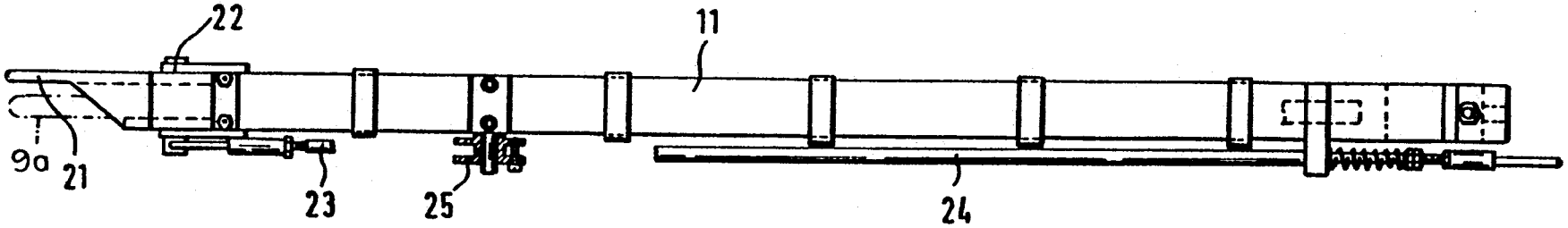
FIG. 3 is a plan view of the latter.

The guide or feed channel 11, shown in greater detail in FIGS. 2 and 3, has an obtuse angle end so oriented that the underside of the wedge-shaped tongue 21 fixed thereon is generally horizontal, i.e. includes an angle of inclination between 0° and 5° with the horizontal.

The tongue 21 is rigidly fixed on the feed channel 11 adjacent the outlet opening the strip 9 and has the form of a finger with a wedge-shaped tip or point toward which the tongue converges.

In the region in which it is fastened to the channel 11, a cutting head 22 is provided for severing individual segments or tabs from the continuous strip 9. The cutter 22 is actuated, in turn, by two rods 23, 24 from a cutting drive received in the feed unit 11 and not shown in any detail here.

Between the rods 23 and 24 a rotary disk 25 is provided, the rods 23 and 24 being pivotally connected to this disk so that, when the rod 24 is subjected to tension in the direction to the right in FIG. 2 by the actuator in the feed unit 10, the disk 25 will be rotated in the counterclockwise sense and will pull the rod 23 in the same direction to thereby operate the cutter 22. A spring 24*a* can serve to bring the cutter back into its inoperative position.

At the outlet end of the feed channel 11 in a region below the abutment of the tongue 21 thereto, on the underside of the feed channel, a proximity sensor 26 is mounted with which the proximity of the tongue 21 to the upper surface of the stack can be detected.

In the embodiment illustrated, this sensor is a light sensor which transmits a horizontal light beam so that the reflection from the surface of the stack is registered by an optical system, not shown in any detail, but incorporated in the sensor 26. The light beam supply and the pickup can be effected by a glass fiber cable 27 fixed on the underside of the feed channel 11. Alternatively we may make use of a capacitive proximity sensor if we so desire.

The width of the marker inserter is less than the width of the abutment board 4 and two neighboring upper belts forming the stacking unit as seen in the direction transverse to the sheet feed direction 2, so that there is place alongside the board and between the belts 3 for the finger 21 to be lowered onto the stack. In addition, the frame 5 can be connected by a bayonet connection to the transverse adjustment of the scanning unit enabling setting thereof for sheets of different sizes or formats to ensure that the tongue 21 will always lie between two belts 3, for example.

The marker inserter of the present invention operates as follows:

In the rest position, the tongue 21 is in a position above the upper side of the stack and outside the vertical projection of the outline of the stack. In FIG. 1, the piston is at its right-hand stop of the piston-cylinder unit 14 and the piston of the unit 18 is at its upper limiting position.

Shortly before the desired number of sheets has been deposited in the stack, the tongue 21 is moved horizontally in the direction opposite the sheet feed direction 1, i.e. in the direction of arrow 10*b*, into a waiting position above the sheets and within the outline or vertical projection of the outline of the stack. This movement is effected by a displacement of the piston of unit 14 into its left-hand limiting position (FIG. 1), the stacking unit formed by the board 4 and the belts 3 may be moved upwardly to provide place for insertion of the tongue 21 if necessary. The waiting position is shown in solid lines in FIG. 1. Once the desired number of sheets have been deposited, the tongue 21 is lowered by a vertical movement downwardly so that its wedge-shaped tip lies between the uppermost sheet of the stack on which is it lowered and the next arriving sheet which deposits on the tongue. The tongue thus lies between the front edges of the successive sheets and further sheets continue to stack on the tongue 21. The approximation of the tongue 21 to the upper side of the stack is detected by the proximity sensor 26 independently of the absolute height of the stack and is controlled so that the underside of the tongue will rest cleanly upon the upper surface of the stack.

A marker tab is inserted by the advance of the strip 9 by an increment equal to the tab length via the feeder 10 through the channel 11 and passed to cutting head 22 alongside the tongue into the gap formed by the tongue. The tongue 21 moves further downwardly with the stack until a sufficient number of paper sheets have been deposited thereon and upon the strip or tab to hold the strip or tab in the stack 1. The tab, of course, is cut off by the cutter from the strip 9 and the downward movement of the tongue 21 is effected by means of the piston-cylinder unit 18.

Then the guide channel 11 with the tongue 21 affixed thereto is moved horizontally by means of the piston-cylinder unit 14 in the direction of the sheet feed 2, i.e. in the direction of arrow 10*a* until the tongue 21 is withdrawn from the stack 1 without changing its inclination to the horizontal. The gap between the sheets is closed to clamp the strip in the stack. There is no danger that the strip will be withdrawn from the stack by the tongue 21, since the strip does not contact the tongue but rather lies alongside it.

Simply to show the relationship, in FIG. 3, a tab or strip has been illustrated at 9*a* in dot-dash lines alongside the tongue 21. The weight of the sheets above the tab hold it in place and the front piece of the sheets are no longer lifted once the tongue has been withdrawn.

The withdrawal action moreover, does not apply any pressure to the sheets.

The force with which the tongue presses on the sheets is held as small as possible and the tongue 21 is then raised above the stacking position to return it to its rest position whereby the cycle can be repeated.

The tongue 21 and the discharge end of the guide channel 11 are thus cyclically moved in a closed rectangular path, exclusively in straight lines which are substantially vertical and horizontal. In the case of automatic size setting of the stacking machine, the frame 5 can be coupled to the transverse adjustment of the stacking unit and moved into proper position while the tongue is in its rest position thereby automatically adjusting the tab inserter as well.

We claim:

1. An apparatus for inserting a marker strip into a stack of sheets during the stacking thereof by the advance of said sheets in succession in a sheet-feed direction to a stack having a front side opposite a side from which the sheets are fed to the stack, said apparatus comprising:

a guide channel mounted at the front side of said stack and extending downwardly and toward said stack, said guide channel having an outlet for a strip adapted to be inserted into said stack;

a wedge-shaped tongue rigidly fixed to said channel adjacent said outlet and having a substantially horizontal underside adapted to rest on said stack and form a gap therein to receive said strip and positioned so that subsequently deposited sheets on said stack while said tongue is in said stack engage said strip and retain it in said stack;

a supply roll feeding said strip into said channel;

a cutter mounted on said channel for severing a marker tab from said strip whereby said marker tab is retained in said stack; and means connected to said channel for displacing same in substantially vertical and horizontal directions whereby the underside of said tongue is withdrawable from said stack substantially horizontally without alteration of an angle of said underside to the horizontal and without shifting the strip held in place by the subsequently deposited sheets.

2. The apparatus defined in claim 1 wherein said means for displacing includes means for defining a closed rectangular path for said tongue with vertical and horizontal path segments.

3. An apparatus for inserting a marker strip into a stack of sheets during the stacking thereof by the advance of said sheets in succession in a sheet-feed direction to a stack having a front side opposite a side form which the sheets are fed to the stack, said apparatus comprising:

a guide channel mounted at the front side of said stack and extending downwardly and toward said stack, said guide channel having an outlet for a strip adapted to be inserted into said stack;

a wedge-shaped tongue rigidly fixed to said channel adjacent said outlet and having a substantially horizontal underside adapted to rest on said stack and form a gap therein to receive said strip;

a supply roll feeding said strip into said channel;

a cutter mounted on said channel for severing a marker tab from said strip whereby said marker tab is retained in said stack;

means connected to said channel for displacing same in substantially vertical and horizontal directions whereby the underside of said tongue is withdrawable from said back substantially horizontally without alteration of an angle of said underside to the horizontal; and a proximity sensor at an end of said channel carrying said tongue and mounted on an underside of said channel for detecting proximity of said tongue and said outlet to an upper surface of said stack.

4. The apparatus defined in claim 3 wherein said proximity sensor includes means for projecting a horizontal light beam and means for registering reflection of said light beam from said stack.

5. An apparatus for inserting a marker strip into a stack of sheets during the stacking thereof by the advance of said sheets in succession in a sheet-feed direction to a stack having a front side opposite a side from which the sheets are fed to the stack, said apparatus comprising:

a guide channel mounted at the front side of said stack and extending downwardly and toward said stack, said guide channel having an outlet for a strip adapted to be inserted into said stack;

a wedge-shaped tongue rigidly fixed to said channel adjacent said outlet and having a substantially horizontal underside adapted to rest on said stack and form a gap therein to receive said strip;

a supply roll feeding said strip into said channel;

a cutter mounted on said channel for severing a marker tab from said strip whereby said marker tab is retained in said stack;

means connected to said channel for displacing same in substantially vertical and horizontal directions whereby the underside of said tongue is withdrawable from said stack substantially horizontally without alteration of an angle of said underside to the horizontal; and a frame carrying said channel, said channel being pivotally mounted on said frame and being biased by a spring into a position wherein the underside of said tongue maintains said angle.

6. The apparatus defined in claim 5, further comprising a traverse extending transverse to said direction, said frame being shiftable on said traverse.

7. The apparatus defined in claim 6 wherein said frame is couplable to a size-adjusting device of a stacker for said sheets.

* * * * *